US006676587B2

(12) United States Patent
Smith et al.

(10) Patent No.: US 6,676,587 B2
(45) Date of Patent: Jan. 13, 2004

(54) INTEGRATED EMBOSS MODULE

(75) Inventors: Ronald R. Smith, Kansas City, MO (US); Scott A. Schimke, Lansing, KS (US)

(73) Assignee: Hallmark Cards Incorporated, Kansas City, MO (US)

( * ) Notice: Subject to any disclaimer, the term of this patent is extended or adjusted under 35 U.S.C. 154(b) by 0 days.

(21) Appl. No.: 09/951,145

(22) Filed: Sep. 13, 2001

(65) Prior Publication Data

US 2003/0050164 A1 Mar. 13, 2003

(51) Int. Cl.[7] ..... B65H 9/00

(52) U.S. Cl. ..... 493/143; 483/28; 483/59; 483/60; 83/532; 101/29; 101/31

(58) Field of Search ..... 101/28, 29, 30, 101/31, 31.1, 32; 493/320, 323, 143; 483/28, 29, 59, 60, 61; 83/954, 532, 552

(56) References Cited

U.S. PATENT DOCUMENTS 3,669,014 A * 6/1972 Spaw et al. ..... 101/3.1
3,901,143 A * 8/1975 Alexander et al. ..... 101/18
4,129,914 A * 12/1978 Jahn ..... 412/17
4,188,815 A * 2/1980 Mizushima ..... 483/29
5,066,351 A * 11/1991 Knoll ..... 156/212
5,070,781 A * 12/1991 Lundstrom et al. ..... 101/32
5,342,276 A * 8/1994 Fujiwara et al. ..... 483/29
5,374,179 A * 12/1994 Swanson ..... 425/384
5,616,112 A * 4/1997 Seto et al. ..... 483/29
5,755,653 A * 5/1998 Nishida ..... 483/1
5,974,961 A * 11/1999 Kazo et al. ..... 101/4
6,000,322 A * 12/1999 To ..... 100/35
6,044,742 A * 4/2000 Sakamoto et al. ..... 83/698.11
6,126,582 A * 10/2000 Dangelmayr et al. ..... 483/28
6,186,936 B1 * 2/2001 Smith et al. ..... 493/338
6,200,245 B1 * 3/2001 Dodo et al. ..... 483/1
6,349,639 B1 * 2/2002 Smith et al. ..... 101/32

* cited by examiner

*Primary Examiner*—Rinaldi I. Rada
*Assistant Examiner*—Gloria R Weeks
(74) *Attorney, Agent, or Firm*—Pillsbury Winthrop LLP

(57) ABSTRACT

The emboss module of the present invention provides for automatic die and bolster conversion. The emboss module includes a frame, a die changer sub-assembly and a bolster sub-assembly. The die changer sub-assembly includes rotatable die changers for automatically registering dies therein, and the bolster sub-assembly includes counters and panels for receiving the sheet of material and the die. Both the die changer and bolster sub-assemblies are adapted for use with emboss and foil dies and counters. Accordingly, a more efficient and scalable emboss system and method for automatically changing dies and bolsters is described herein.

24 Claims, 15 Drawing Sheets

INTEGRATED EMBOSS MODULE

FIELD OF THE INVENTION

The present invention relates to an integrated emboss module, and more particularly to an embossing system and method that provide automatic changing of dies and bolsters, thereby embossing materials in a more efficient and scalable manner.

DESCRIPTION OF THE PRIOR ART

Emboss modules have been in existence for many years and are used to form embossments or raised portions on materials including paper, card, plastic, cardboard, and the like. For example, social expression cards or greeting cards are embossed using dies having various shapes and styles to provide consumers a wide selection of decorative features on the cards. Emboss or foil dies can be used to form such embossments.

Conventional emboss modules typically use male and female dies configured in a predetermined shape and style. A sheet of material such as paper or greeting card is positioned in between the male and female dies as the two dies are pressed together in a complementary manner, thereby forming embossment(s) in the material. In other emboss modules, a flexible counter such as the one described in the U.S. Pat. No. 6,186,936, title "Paper Embossing System with a Flexible Counter and Method of Embossing," assigned to the common assignee of record, is used in lieu of the male die. In such modules, the female die is pressed against the sheet of material resting on the flexible counter. The flexible counter can be positioned on a bolster for receiving the sheet of material and the female die.

However, the above described conventional emboss modules have various drawbacks. For instance, an emboss module operator is generally required to manually replace and re-position the dies and/or counters whenever a different embossment shape or style is desired on the material. In this case, the emboss module is turned off, while the operator replaces, re-aligns, re-positions, etc., the different die(s) and counter(s) within the module. In other words, the operator manually performs "make-ready" operations such as stopping, changing, moving, positioning, etc., the different components (i.e., dies and counters) associated with the emboss module. Whenever a different die is desired, the operator takes the die out of the emboss module and replaces it manually. Additionally, a bolster having the counter therein is manually re-positioned within the emboss module and tested using a trial and error method before mass production.

Another drawback with conventional emboss module is that they do not have automatic locking and registering components for dies and bolsters. The dies and bolsters are typically integrated into the embossing module using screws, flat heads, and the like. In other words, changing dies or bolsters integrated within the emboss module is a time consuming and laborious undertaking.

SUMMARY OF THE INVENTION

In view of the above described problems of the prior art, it is an object of the present invention to provide a more efficient and scalable emboss system and method for automatically changing dies and bolsters.

It is another object of the present invention to provide a system and method that automatically changes dies and bolsters without requiring "make-ready" operations.

It is a further object of the present invention to providing an emboss system and method for changing dies and bolsters with minimal effort and adjustments by an operator.

It is yet a further object of the present invention to provide an emboss system and method that automatically registers dies and die changers.

It is still another object of the present invention to provide an emboss system that includes die changer and bolster sub assemblies.

It is another object of the present invention to provide an emboss system that can be converted from one using emboss dies to foil dies and vice versa in a matter of seconds.

These and other objects of the present invention are obtained by providing an emboss system (or module) having a frame, a die changer sub-assembly and a bolster sub-assembly. The die changer sub-assembly includes at least a pair of rotatable die changers for automatically registering dies therein. The bolster sub-assembly includes a counter and panels for receiving the sheet of material and the die. When the die changer and bolster sub-assemblies are integrated into the frame, dies and bolsters can be automatically changed to provide for a more efficient and scalable emboss system. Both the die changer and bolster sub-assemblies are adapted for use with emboss and foil dies and counters. During operation, the sheet of material is placed on the bolster and pressed upon the die, thereby forming embossment(s) on the sheet of material.

BRIEF DESCRIPTION OF THE DRAWINGS

These and other objects and advantages of the present invention will become apparent and more readily appreciated from the following detailed description of the presently preferred exemplary embodiments of the invention taken in conjunction with the accompanying drawings, of which.

DETAILED DESCRIPTION OF THE PREFERRED EMBODIMENTS

Figure 1:
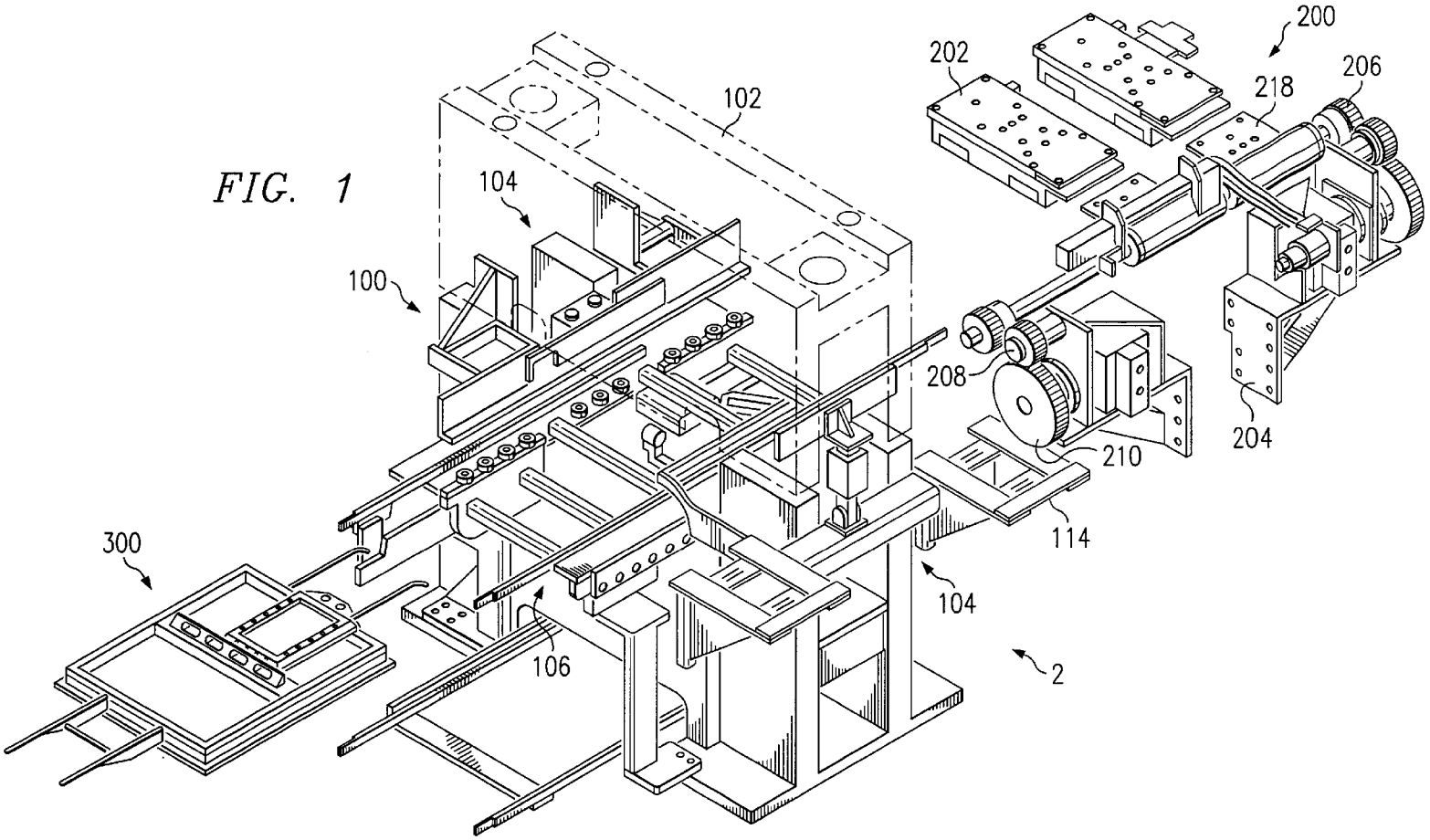
FIG. 1 illustrates a perspective view of an emboss module without the die changer and bolster sub-assemblies integrated therein in accordance with the present invention.

The present invention will now be described in greater detail, which will serve to further the understanding of the preferred exemplary embodiments of the present invention. As described elsewhere herein, various refinements and substitutions of the various embodiments are possible based on the principles and teachings herein.

The preferred embodiments of the present invention will now be described with reference to FIGS. 1–17, wherein like components, steps, etc. are designated by like reference numerals throughout the various figures. Further, specific details and parameters are provided herein and are intended to be explanatory rather than limiting.

The present invention relates to an emboss system and method for automatically changing dies and bolsters. The emboss system of the present invention includes a frame, a die changer sub-assembly, and a bolster sub-assembly. The die changer sub-assembly includes at least a pair of rotatable die changers for registering dies therein. The die changers are rotatable in both clockwise and counter-clockwise directions in order to register the die(s) and emboss the sheet of material. The die changer and the die changer registration system are also believed to be novel and are described in the co-pending U.S. patent application Ser. No. 09/951,144 , Attorney Docket No. 34062/0272096, filed concurrently herewith, titled "Die Changer with Cone Hole Registration System," and assigned to the common assignee of record.

The bolster sub-assembly includes counters and panels for receiving a sheet of material such that the die registered in the die changer can emboss the material. Accordingly, when the die changer and bolster sub-assemblies are integrated into the frame, dies and bolsters can be automatically changed. During operation, the sheet of material is placed on the bolster sub-assembly while the die is pressed thereon, thereby forming embossment(s) on the sheet of material. The presently preferred embodiments will now be described with reference to a sheet of paper, although other materials such as cards, cardboards, plastics, etc., can be used in the present invention.

Figure 2:
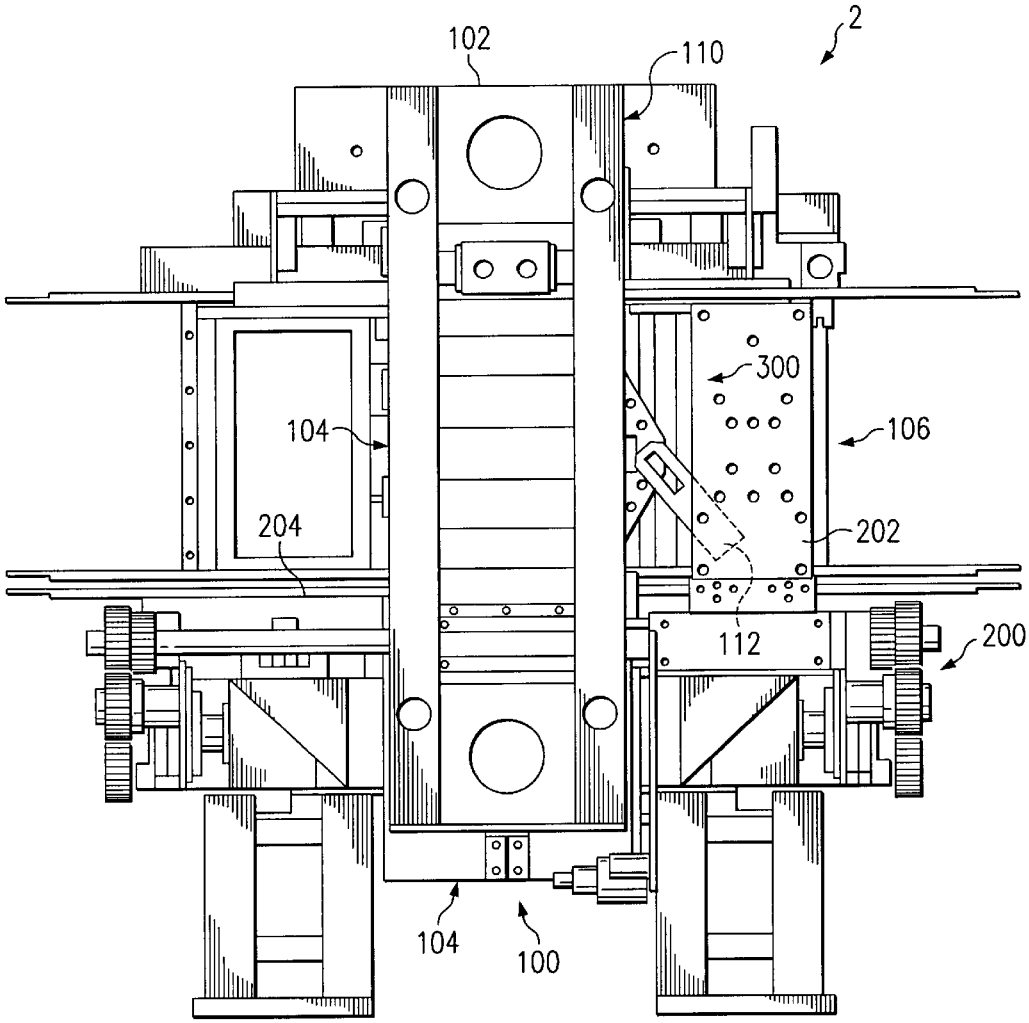
FIG. 2 illustrates a top view of the emboss module of FIG. 1 with the die changer and bolster sub-assemblies integrated therein in accordance with the present invention.
Figure 3:
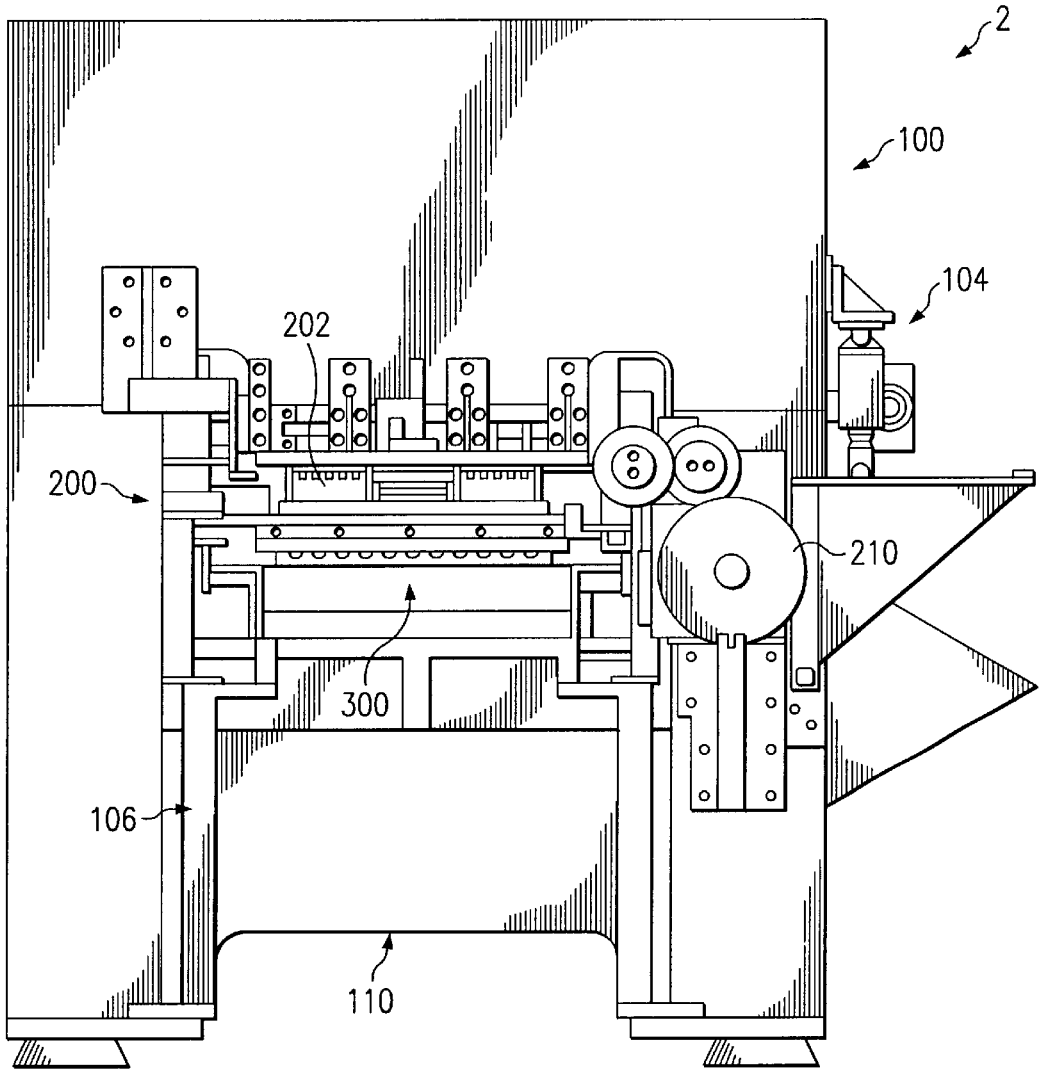
FIG. 3 illustrates a side view of the emboss module of FIG. 1 with the die changer and bolster sub-assemblies integrated therein in accordance with the present invention.

FIG. 1 illustrates a perspective view of the emboss module without the die changer and bolster sub-assemblies integrated therein for ease of understanding and explanation. FIGS. 2 and 3 illustrate top and side views, respectively, of the emboss module of FIG. 1 with the die changer and bolster sub-assemblies integrated therein in accordance with the present invention. Reference will be made concurrently to FIGS. 1–3 for a more complete understanding of the invention.

The emboss module 2 includes a frame 100, a die changer sub-assembly 200, and a bolster sub-assembly 300. In FIG. 1, the top portion 102 of the frame 100 is removed for clarity and ease of understanding. The frame 100 receives both the die changer sub-assembly 200 and the bolster sub-assembly 300 to form the integrated emboss module 2. As will be described in greater detail below, the die changer sub-assembly 200 is used to automatically change die or dies, and the bolster sub-assembly 300 is used to automatically change counters and panels during the embossing process. The dies and counters or panels are changed with minimal participation from an operator and without performing "make-ready" operations. The frame 100 further includes a die changer registration system 104 for registering the die changer sub-assembly 200 into the frame 100. The frame 100 also includes a scotch yoke 106, gripper bars, and a bolster receiving arm 112 for receiving the bolster sub-assembly 300 therein, which components are described in greater detail below.

The emboss module 2 is basically a hydraulic power press 110 and is capable of automatically registering the die changer sub-assembly 200 therein. Commands for setting up, controlling, calibrating, positioning the emboss module 2 and the various components and sub-assemblies are performed via a computing system, as known in the art. Hardware and software are implemented within the computing system to control the emboss system and process control feed back. In addition, digital information for production matting of the die, tonnage, and proper sheet material design can be performed using bar code technology, again as known in the art. During operation, the emboss module 2 compresses a sheet of paper between the die and the counter or panel (described later herein). The compression creates tactile change of paper for texture, raised lettering, styled framing panel, and other embossment features, as known in the art.

During operation, the die is positioned on the die changer 202 that is typically preheated. The die changer 202 includes pre-drilled holes mated with pins therein. The die includes beveled edges cut to allow toggle clamps to hold the die on the die changer 202. The die changer 202 is registered into the swing arm 204 and rotated into position, the swing arm 204 being shuttled into the frame 100 and the die changer 202 is registered with the die changer registration system 104. When the die changer 202 is in the embossing position, another die changer 202 is simultaneously rotated out of the frame 100 for the next die to be placed therein. The die can be an emboss or foil die. The bolster sub-assembly 300 shuttles, for example, a single panel flexible counter into position for the single panel emboss dies and shuttles an alternate triple panel flexible counter into position for double panel and triple panel emboss dies. The bolster sub-assembly 300 is shuttled from the underside of the emboss module 2 from, for example, large to small format, or from flexible counter emboss to foil stamping.

FIGS. 4–17 illustrate more detailed views of the various components and subassemblies associated with the emboss module 2. In the following descriptions, it is understood that other components, devices, and parts than those describe below may be substituted and are intended to be within the scope and spirit of the present invention. In addition, well known components, devices, functions, and the like will not be described in great detail since they are well known in the art.

Figure 4:
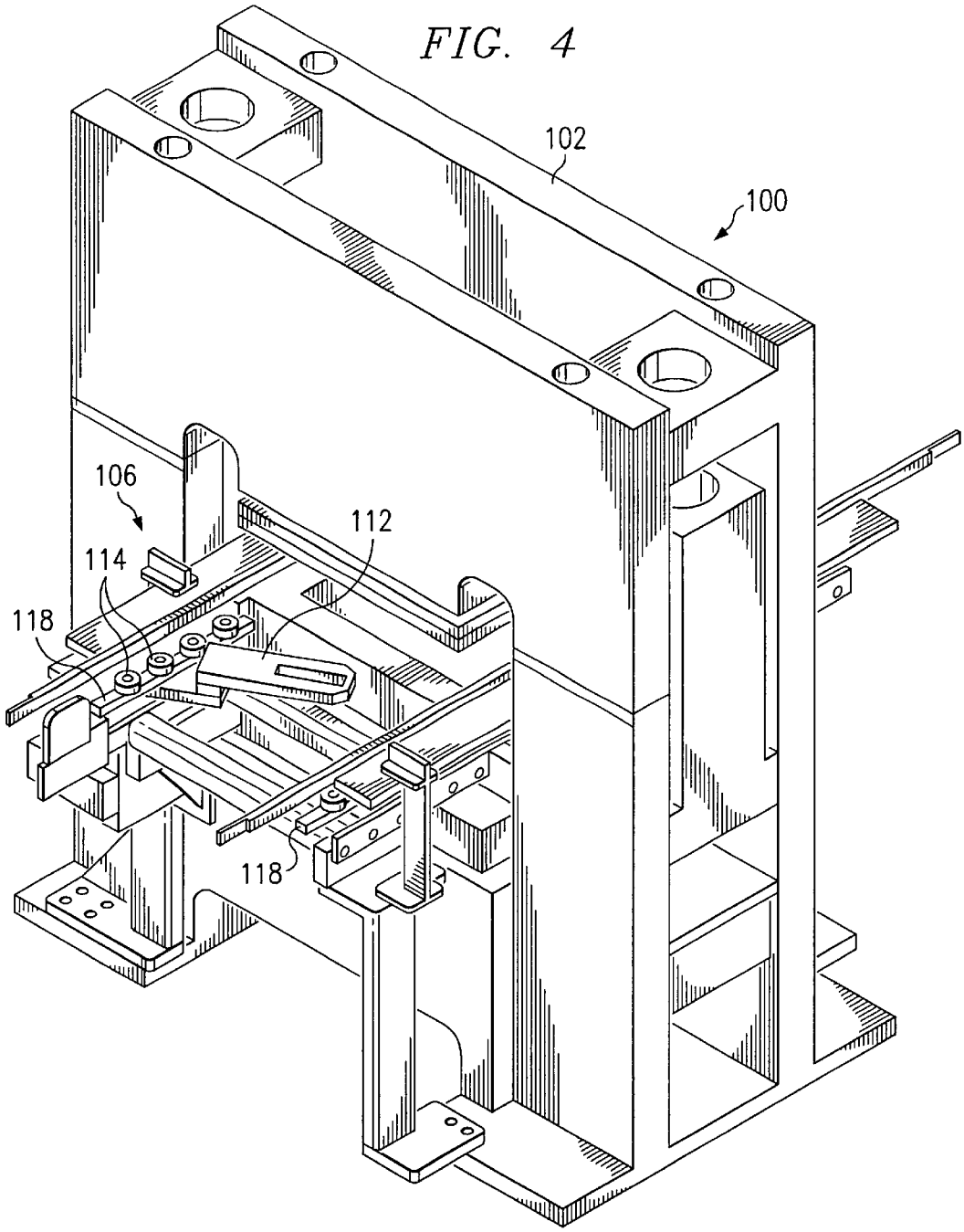
FIG. 4 illustrates a detailed perspective view of a scotch yoke integrated with the emboss module in accordance with the present invention.
Figure 5:
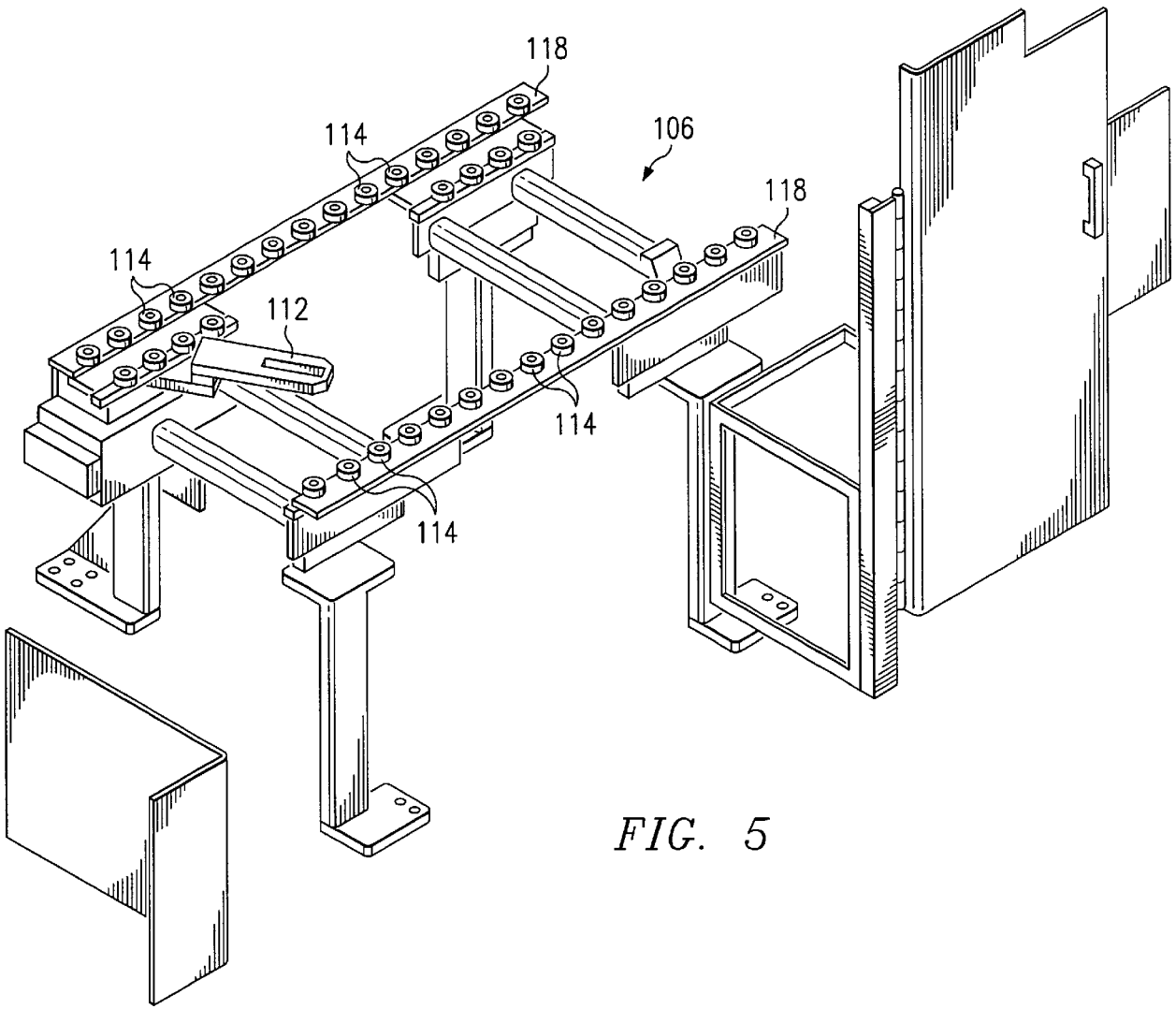
FIG. 5 illustrates a detailed perspective view of the scotch yoke of FIG. 4 in accordance with the present invention.

FIG. 4 illustrates a detailed perspective view of a scotch yoke integrated with the emboss module, and FIG. 5 illustrates a detailed perspective view of the scotch yoke of FIG. 4. The scotch yoke 106 includes a pair of scotch yoke assembly or rails 118 that are in parallel to each other. The gripper bars are used for guiding the sheet of material into and out of the emboss module 2 and are well known in the art, and each gripper bar is placed in parallel with each other through the frame 100. The scotch yoke assembly or rails 118 include multiple guiding devices or wheels 114 to guide the bolster sub-assembly 300 into and out of the frame 100. The scotch yoke 106 further includes a bolster receiving arm 112 for engaging the bolster sub-assembly 300. For example, during operation, the bolster receiving arm 112 engages the bolster sub-assembly 300 and guides it into the frame 100 using the guiding devices or wheels 114 on the gripper bars. Although only two gripper bars and one receiving arm 112 are illustrated herein, it is understood that in other embodiments more or less then two gripper bars or one receiving arm 112 can be used. Also, the receiving arm 112 is connected to a hydraulic unit, servo driver (not shown) or other driving mechanism to move and engage the bolster sub-assembly 300 into and out of the frame 100. The bolster sub-assembly 300 includes counter or panels that can weigh up to 350 pounds. For instance, it is well known that a foil production requires 30–50 tons to raise the image, a single emboss production requires 75–150 tons to raise the image, and a triple emboss production requires between 200–300 tons to raise the image.

Figure 6:
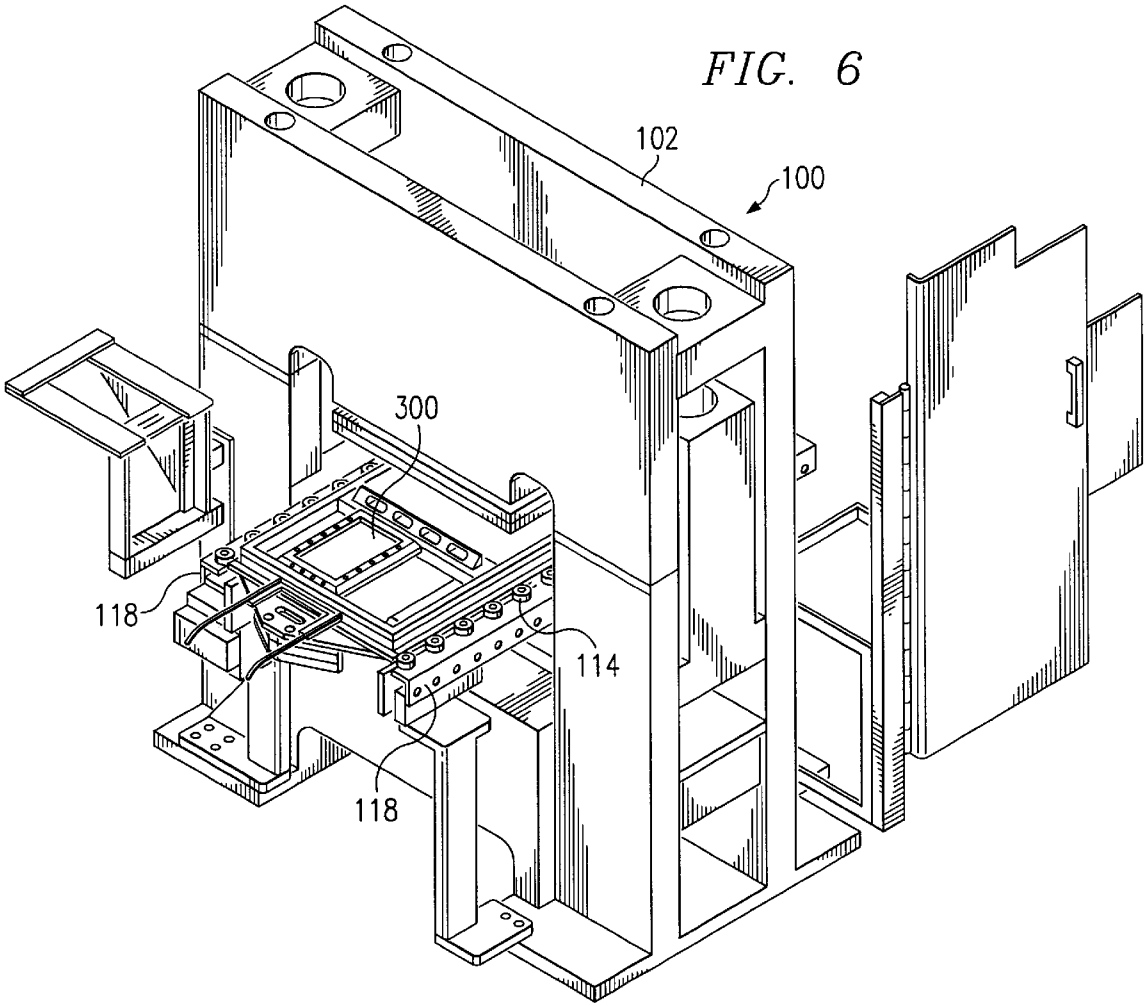
FIG. 6 illustrates a detailed perspective view of the bolster sub-assembly integrated with the emboss module in accordance with the present invention.

FIG. 6 illustrates a detailed perspective view of the bolster sub-assembly 300 integrated with the emboss module 2 or frame 100 in accordance with the present invention. After the bolster sub-assembly 300 is locked into place, it moves into and out of place in the frame 100 via a hydraulic unit or other driving mechanism using the wheels 114 to guide on the scotch yoke assembly or rails 118, as described above.

Figure 7:
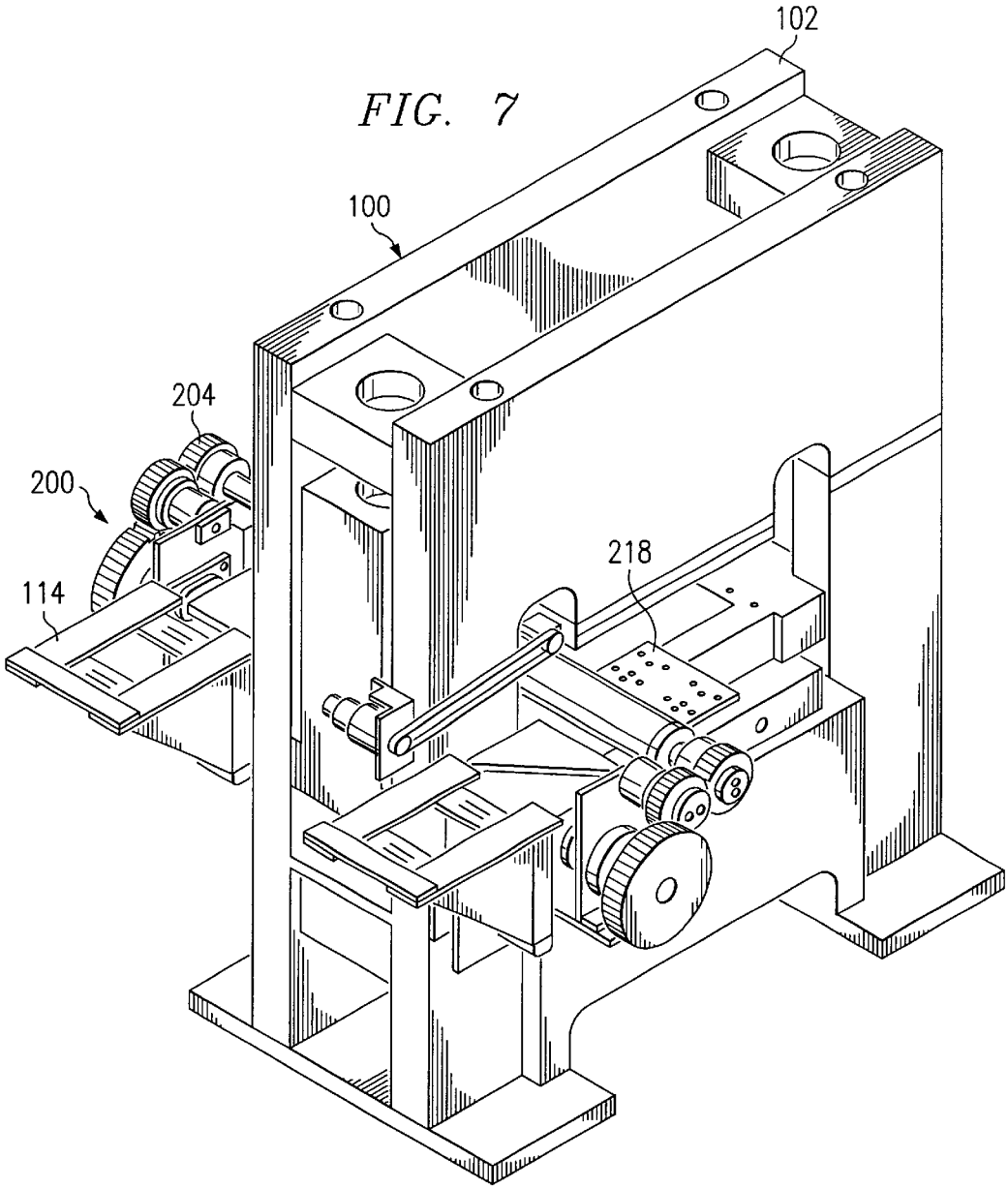
FIG. 7 illustrates a detailed perspective view of the die changer sub-assembly integrated with the emboss module in accordance with the present invention.

FIG. 7 illustrates a detailed perspective view of a die changer sub-assembly integrated with the emboss module in accordance with the present invention. The die changer sub-assembly 200 is placed with the frame 100. In FIG. 7, the die changer sub-assembly 200 is shown with the swing arm 204 and die changer receiving ports 218, but without the die changers 202 registered therein. The frame 100 also includes a complementary die changer resting plates 114 that are used during the die changing process, which function will be described more fully below in reference to FIG. 8.

Figure 8:
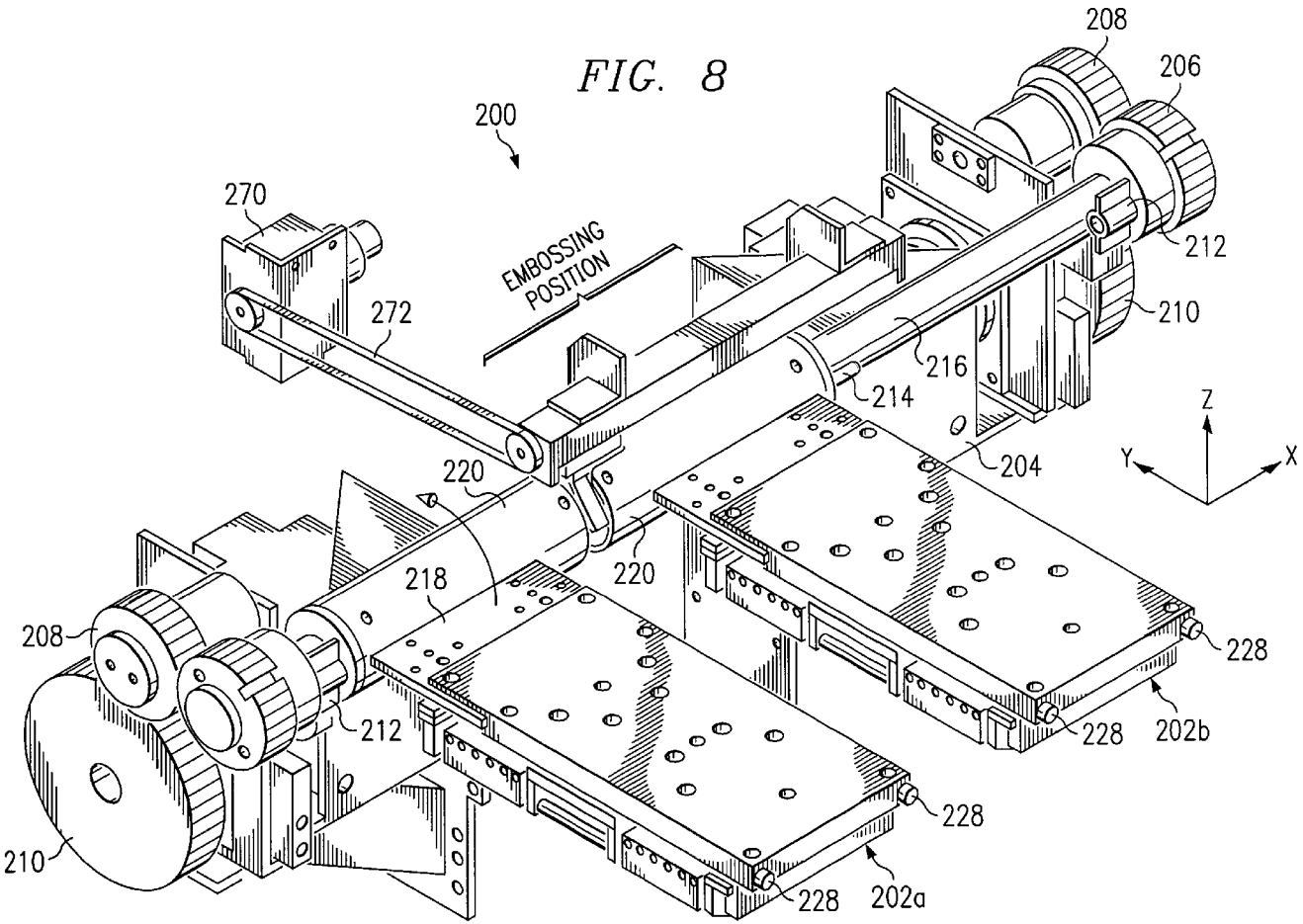
FIG. 8 illustrates a detailed perspective view of the die changer sub-assembly in accordance with the present invention.

FIG. 8 illustrates a detailed perspective view of the die changer sub-assembly in accordance with the present invention. The die changers 202 (202*a* and 202*b*) are illustrated facing down and registered in the die changer receiving ports 218. The die changers 202 are registered into the die changer receiving ports 218 using a register catch methodology. As will be described in reference to FIG. 15, the die changers 202 also includes cam followers 228 for registering into the frame 100. The face down position allows for the sheet of material to be embossed with a die. In greater detail, the die changer sub-assembly 200 includes several pair of gears 206, 208, 210 and a shaft 216 connecting the pair of gears 206 to each other. The die changer receiving ports 218 are connected to the shaft 216 via cylindrical rollers 220. The cylindrical rollers 220 allow the die changers 202 to rotate in both clockwise and counter-clockwise directions about the X-axis. In addition, the rollers 220 are capable of moving along the X-axis through the shaft 216. This is important function since this allows each die changer 202 to be rotated about the X-axis.

For instance, as currently illustrated in FIG. 8, the bottom-left die changer 202*a* can be rotated, for example 180 degrees, in the counter-clockwise direction so that a different die can be placed therein. When rotated, the die changer 202*a* would be facing up, and the existing die would be replaced with a different die. Concurrently, the other die changer 202*b* can be used to emboss the sheet of material. Thereafter, when the different die is placed on the die changer 202*a* and such die is needed for embossing, the die changer 202*a* is rotated back 180 degrees to the position shown in FIG. 8. Then, both the die changers 202*a*, 202*b* are shifted in the X-axis direction towards the upper right portion of the shaft 216 such that the die changer 202*a* is positioned to emboss the sheet of material. The die changer 202*b* can now be rotated, for example 180 degrees, in the counter-clockwise direction about the X-axis so that a different die can be placed therein. The die changer resting plates 114 are used to hold the die changers 202 when dies are being replaced. In this manner, automatic changing of the die can be performed with minimal interruption and no "make-ready" operations during the embossing process.

The die changers 202*a*, 202*b* are shifted along the X-axis direction using an actuator 270 having a belt 272 and pulley system therein. When the die changers 202*a*, 202*b* are shifted along the X-axis direction of the shaft 216 using the rollers 220, the following mechanism can be used to lock or register them into place. For example, the rollers 220 include tangs 214 that lock into the tang ports 212. Once engaged or locked, the swing arm 204 can rotate one of the die changers about the X-axis.

Again, the rollers 220 can be rotated or shifted in the manner described above using a hydraulic unit, servo driver or other driving mechanism. These driving mechanisms should provide the necessary torque and power to rotate the die-changers 202, which can weigh over 100 pounds, in both clockwise and counter-clockwise directions and in the X-axis direction.

Figure 9:
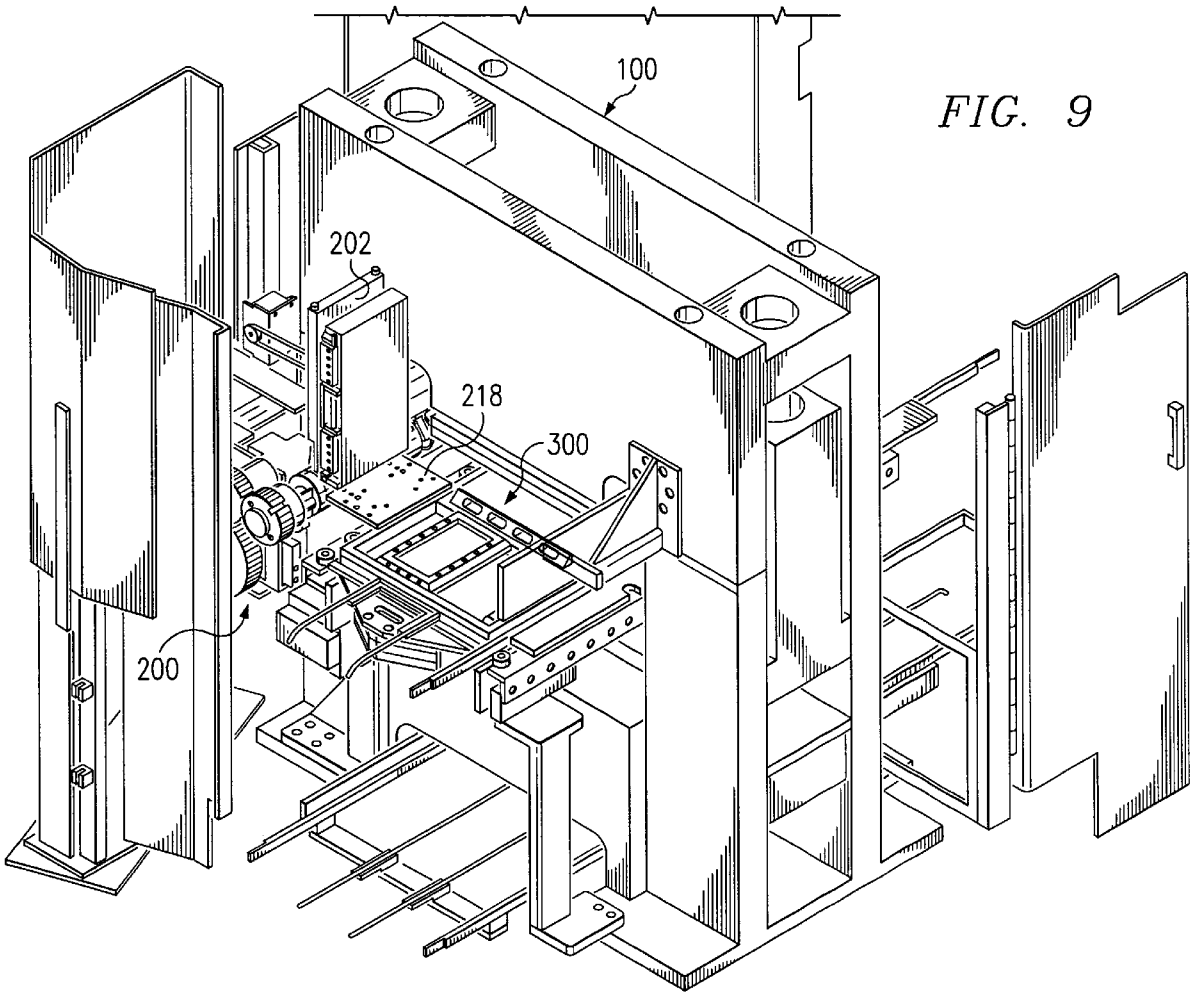
FIG. 9 illustrates a detailed perspective view of the bolster and die changer subassemblies integrated with the emboss module in accordance with the present invention.

FIG. 9 illustrates a detailed perspective view of a bolster and die changer subassemblies integrated with the emboss module in accordance with the present invention. The die changer 202 is illustrated in a vertical position in order to illustrate the bolster sub-assembly 300. When the die changer 202 is registered in the die changer receiving port 218, the sheet of material that is placed on the bolster sub-assembly 300 can be embossed.

Figure 10:
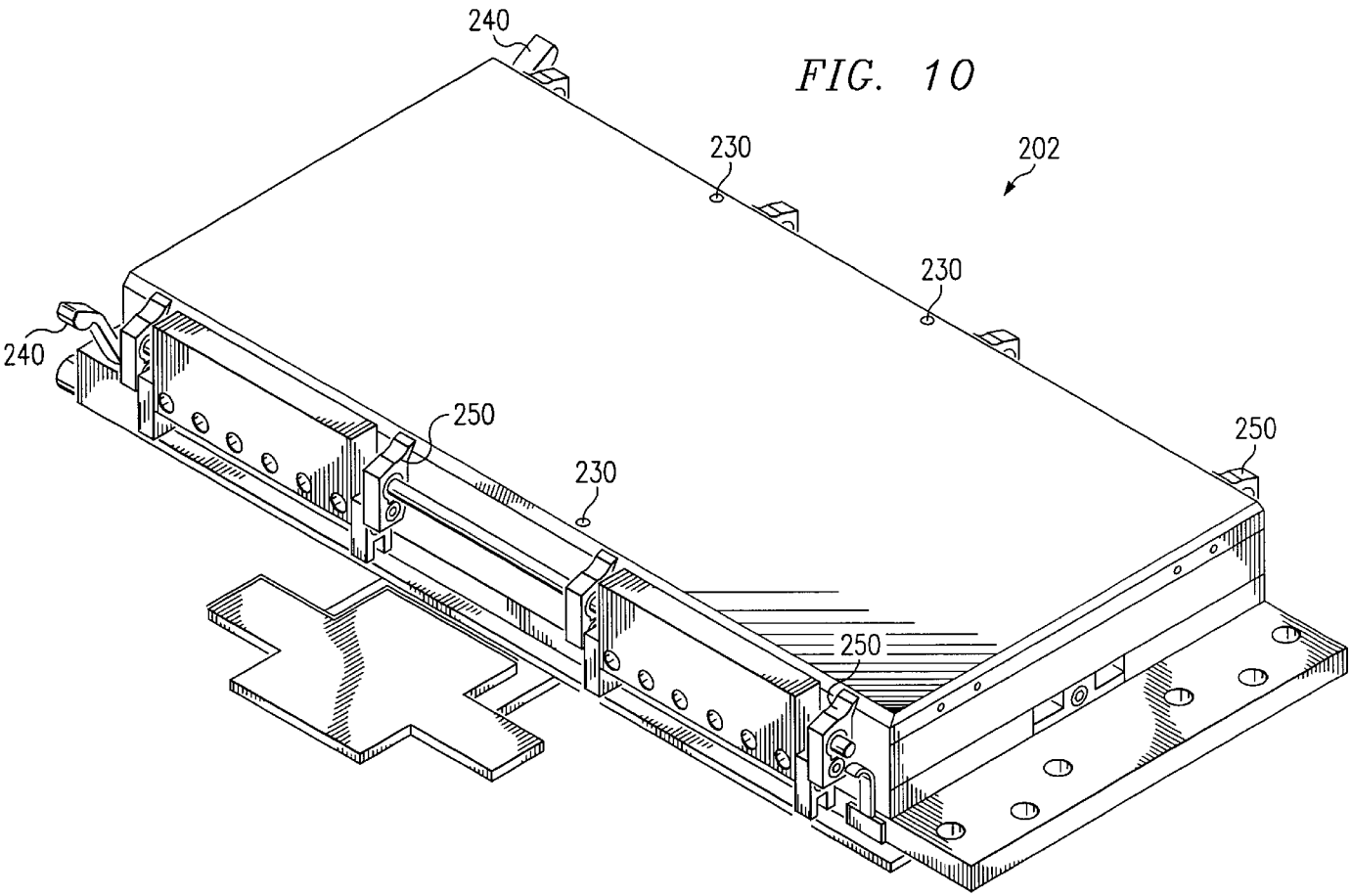
FIG. 10 illustrates a detailed perspective view of the die changer in accordance with the present invention.

FIG. 10 illustrates a detailed perspective view of a die changer in accordance with the present invention. The die changer 202 can be used for both emboss and foil dies. The die (not shown) is positioned on the die changer 202 by matching the pin holes on the die with the pins 230 on the die changer 202. In other words, the die is placed on the die changer 202 with pre-drilled locator pin holes mated with the pins 230 on the die changer 202. With the die registered to the pins 230 and nested flat, two toggle clamp thumb trigger levers 240 are used to release and lock the die therein. For example, when the trigger levers 240 are pushed in, the die will be released, and when the trigger levers 240 are pulled out, the die will be locked in the die changer 202. An emboss die includes beveled edges to allow the toggle clamps 250 to hold the die on the die changer 202. Again, the die changer 202 and die changer registration system 104 are also believed to be novel in themselves and are described in greater detail in the co-pending U.S. patent application Ser. No. 09/951,144, Attorney Docket No. 34062/0272096, titled "Die Changer with Cone Hole Registration System," filed concurrently herewith and assigned to the common assignee of record.

Figure 11:
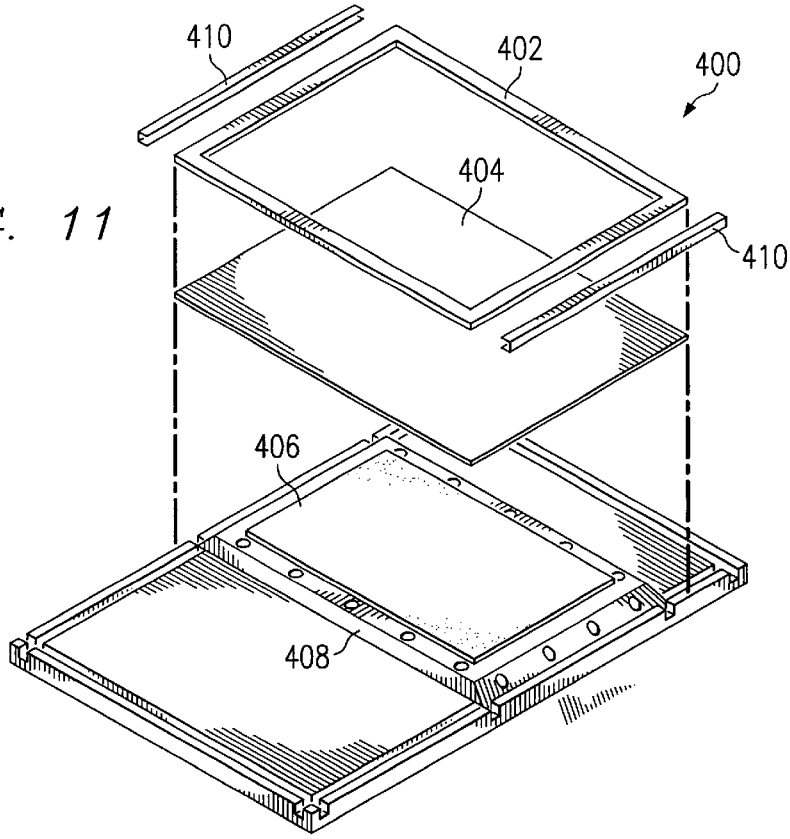
FIG. 11 illustrates a detailed perspective view of a flexible counter in accordance with the present invention.
Figure 12:
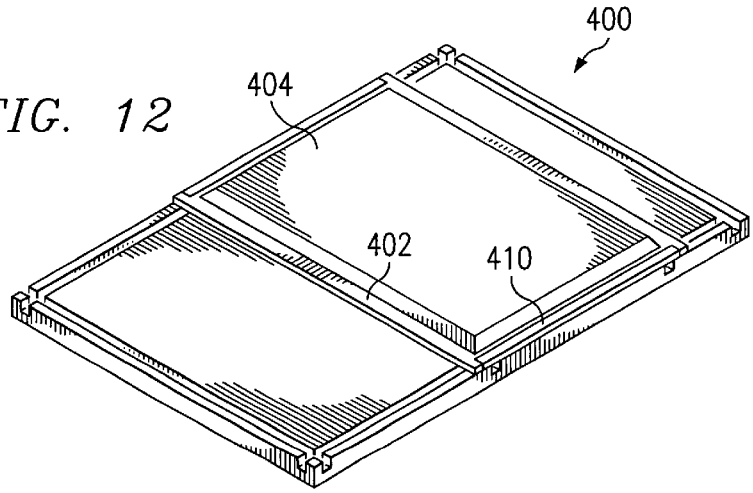
FIG. 12 illustrates another detailed perspective view of the flexible counter in accordance with the present invention.

FIGS. 11 and 12 illustrate detailed perspective views of a flexible counter in accordance with the present invention.

FIGS. 11 and 12 illustrate the flexible counter 400 with the single panel rails containing a rubber mat and bumper seals. The flexible counter 400 is place on the bolster sub-assembly 300 for embossing the sheet of material. A flexible counter that is described in the U.S. Pat. No. 6,186,936, titled "Paper Embossing System with a Flexible Counter and Method of Embossing," and assigned to the common assignee of record, can be used in conjunction with the emboss module 2. In one embodiment of the present invention, the emboss module 2 requires a flexible counter 400 having a slip sheet frame 402, a slip sheet 404, a rubber mat 406 and bumper seals 408. The U-shaped clamps 410 holds the slit sheet 404 in place as a friction-reducer. The friction-reducing film reduces damage to the sheet of material and aids in removing the sheet from the flexible counter 400 after embossing.

The flexible counter 400 also aids with the rubber thickness profiling. The rubber thickness will vary to the point of nesting below or above the bumper seals 408. The rubber mat 406 is nested in position to match the surface height of the bumper seals 408. The matching surface height is accomplished by shims added or subtracted under the rubber mat 406. The bumper seals 408 are positioned peripherally around upper sides of the rubber mat 406 on the side walls that have grooves sized for the bumpers.

The flexible counter 400 is placed on the bolster sub-assembly 300 before performing the embossing process. The thickness of the rubber mat 406 that is profiled to match the surface height of the bumper seals is accomplished with shims when assembling the flexible counter 400 into the bolster sub-assembly 300. The excess portions of the slip sheet 404 over the rubber mat 406 and the bumper seals 408 are laid over the two ends of the slip sheet frame 402, and the U-shaped clamps 410 are used to hold the slip sheet 404 in place. In FIG. 12, the slip sheet 404, slip sheet frame 402, and U-shape clamps 410 are assembled with the slip sheet 404 ends rolled over the frame ends and clamped.

Figure 13:
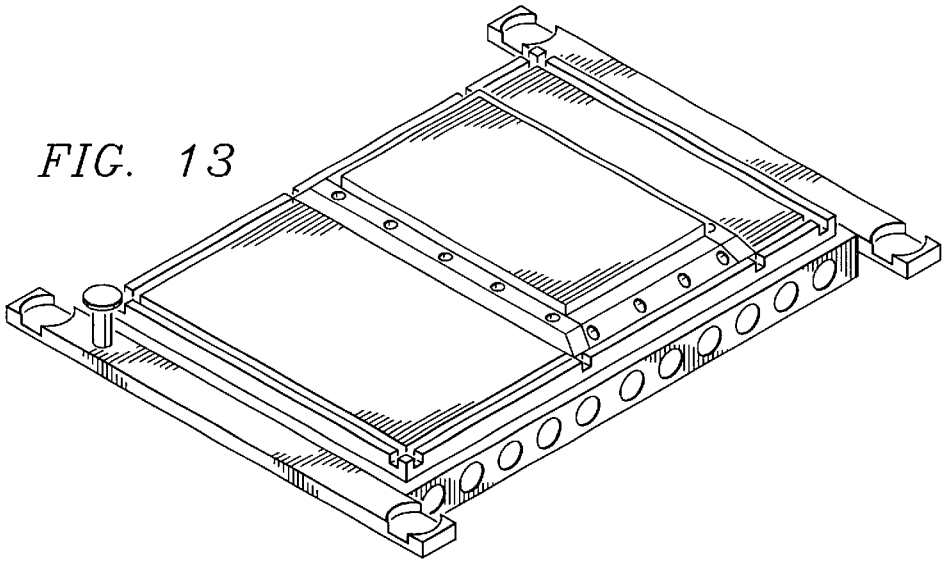
FIG. 13 illustrates a detailed perspective view of a triple panel counter converted into the foil counter in accordance with the present invention.

FIG. 13 illustrates a detailed perspective view of a triple panel counter converted into the foil counter in accordance with the present invention. The triple panel counter can be converted into a single panel flat foil counter for foil dies. The emboss module 2 will accept a hot stamp stream-roll foil feeder system for alternative gold or color hot stamp foil. Hot stamp foil dies will be registered and locked on the die changer 202 in the manner described in reference to FIG. 10.

Figure 14:
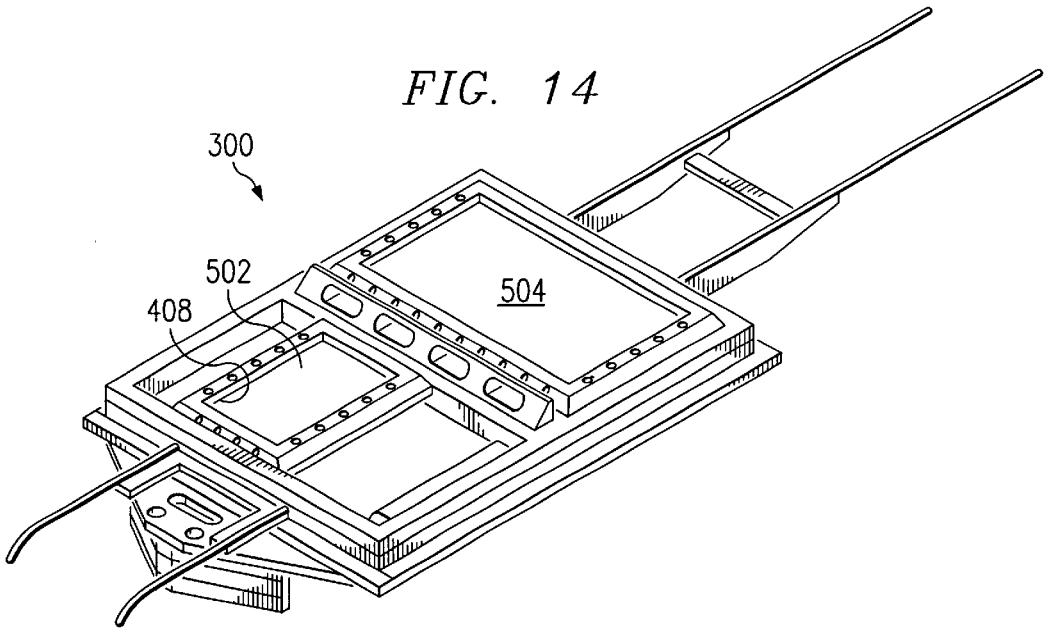
FIG. 14 illustrates a detailed perspective view of the bolster sub-assembly in accordance with the present invention.

FIG. 14 illustrates a detailed perspective view of a bolster sub-assembly in accordance with the present invention. The bolster sub-assembly 300 is shuttled into position by the scotch yoke 106 to align the single panel counter 502 and triple panel counter 504 in position for the respective emboss die. The bolster sub-assembly 300 shuttles the single panel counter 502 into position for the single panel emboss dies and shuttles the triple panel counter 504 into position for double panel and triple panel emboss dies. The triple panel counter 504 can be converted into a single panel flat foil counter 502 for foil dies. The bolster sub-assembly 300 shifts within the frame 100 such that different type of embossing can be performed. For instance, the bolster sub-assembly 300 includes counters for small format or single panel, triple panel, and foil.

Figure 15:
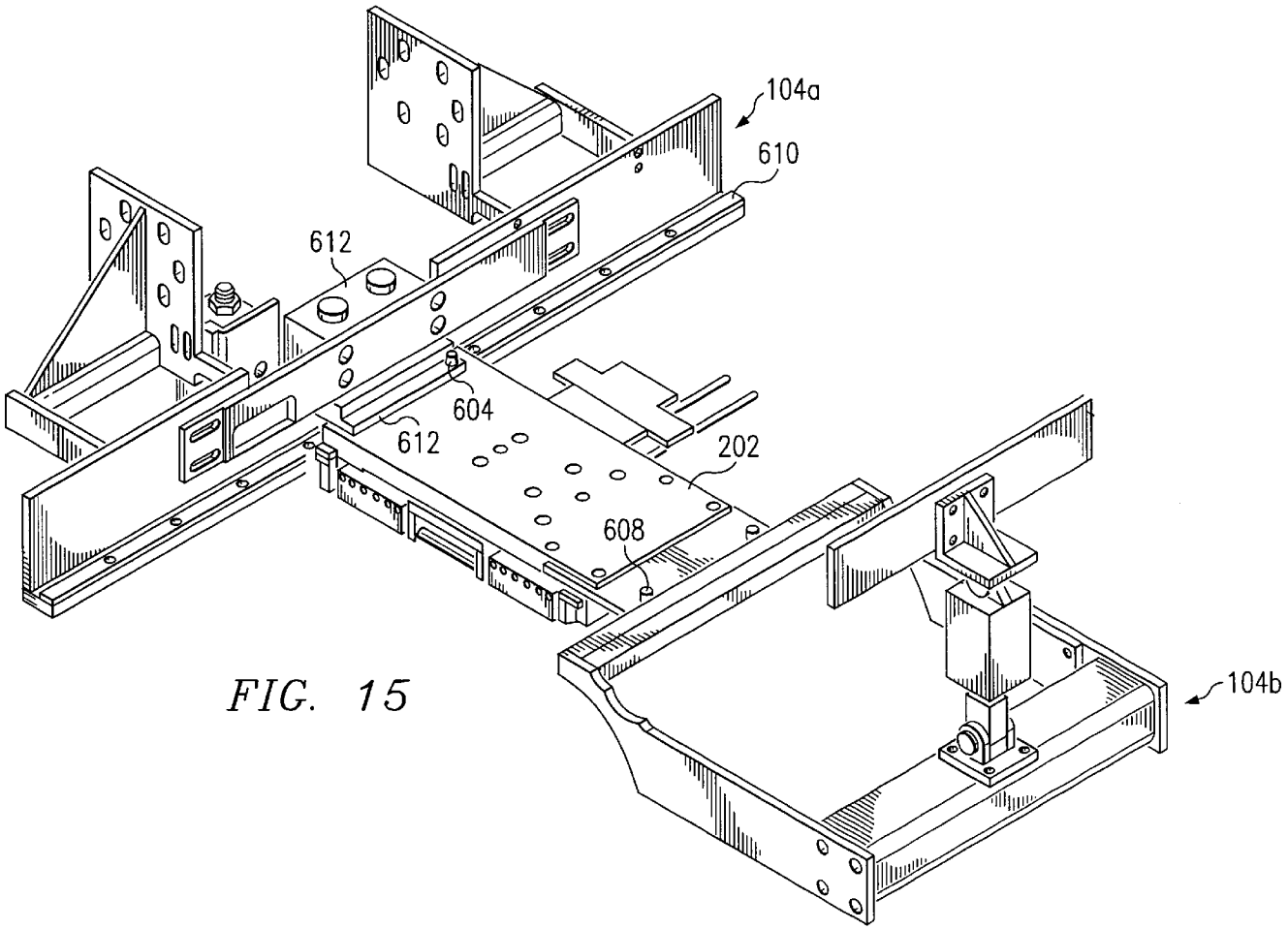
FIG. 15 illustrates a detailed perspective view of a die changer registration system in accordance with the present invention.

FIG. 15 illustrates a detailed perspective view of a die changer registration system in accordance with the present invention. FIG. 15 is showing the registration system 104 without the frame 100 and die-changer sub assembly 200. The registration system 104 includes a first registration component 104*a* and second registration component 104*b*. The first registration component 104*a* includes clamp 612 between rails 610. The clamp 612 between the rails 610 locks and registers the die changer 202. The die changer's cam followers 228 roll over the clamp 612 and straddle a pair of cone pins 604 for registration of the die changer 202. The second registration component 104*b* includes a lock bottom 608 for further registering the die changer 202 within the frame 100. The register dog swing arm 602 registers the gripper bars material handling. The register dog swing arm 602 actuates in a rotation motion in both clockwise and counter-clockwise directions.

Figure 16:
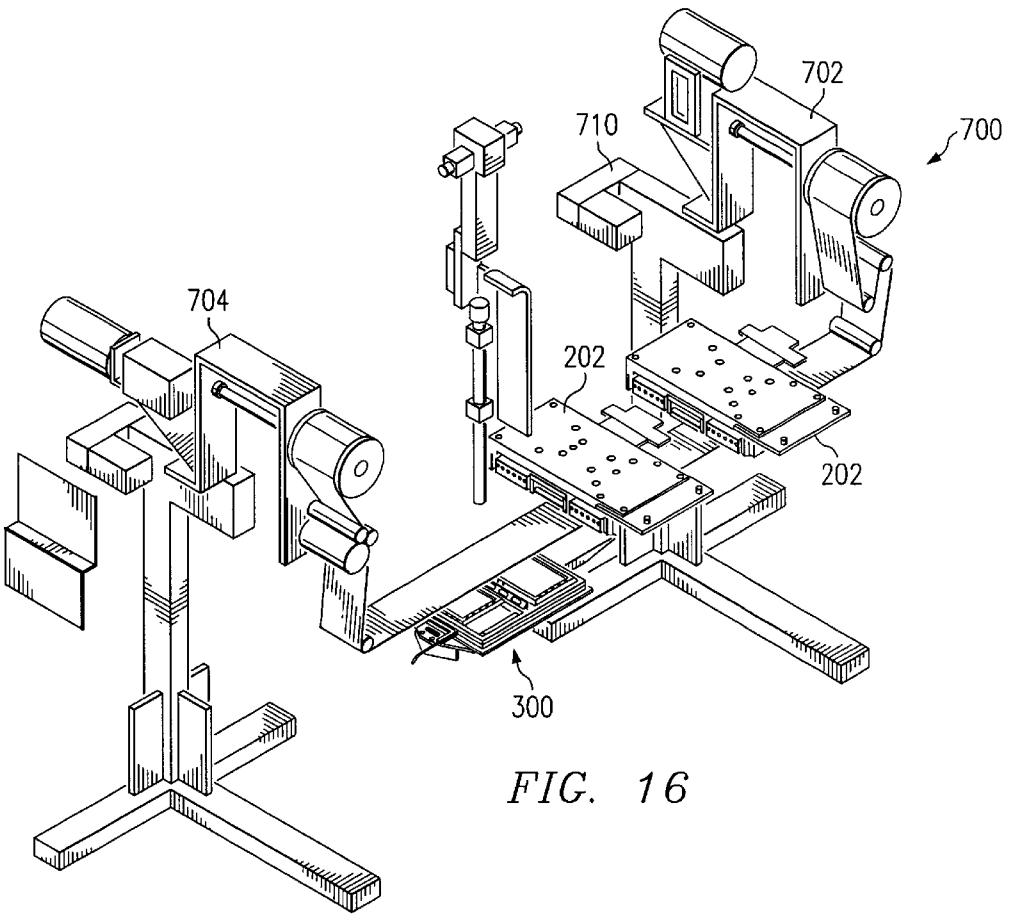
FIG. 16 illustrates a detailed perspective view of an emboss module for foil counter in accordance with the present invention.

FIG. 16 illustrates a detailed perspective view of an emboss module for foil embossing in accordance with the present invention. FIG. 16 illustrates a foil feeder 700, die changers 202 and the bolster sub-assembly 300, without the frame 100, for clarity. When foil stamping is desired, the foil feeder 700 is moved into position using the line actuator 710, and the foil is wound and unwound using the unwind stand 702 and the rewind stand 704. The foil feeder 700 feeds foil through the emboss module 2 for foil stamping operations. When regular embossing operation is desired, the unwind and rewind stands 702, 704 are retracted. The die changers 202 and the bolster sub-assembly 300 are shown in relative position to highlight the functional path of the foil.

With this functionality, the emboss module 2 can be used for both emboss and foil operations, and such automatic conversion can be performed in a matter of seconds. As known, conventional emboss modules generally a great deal of time and effort to make such change over.

Figure 17:
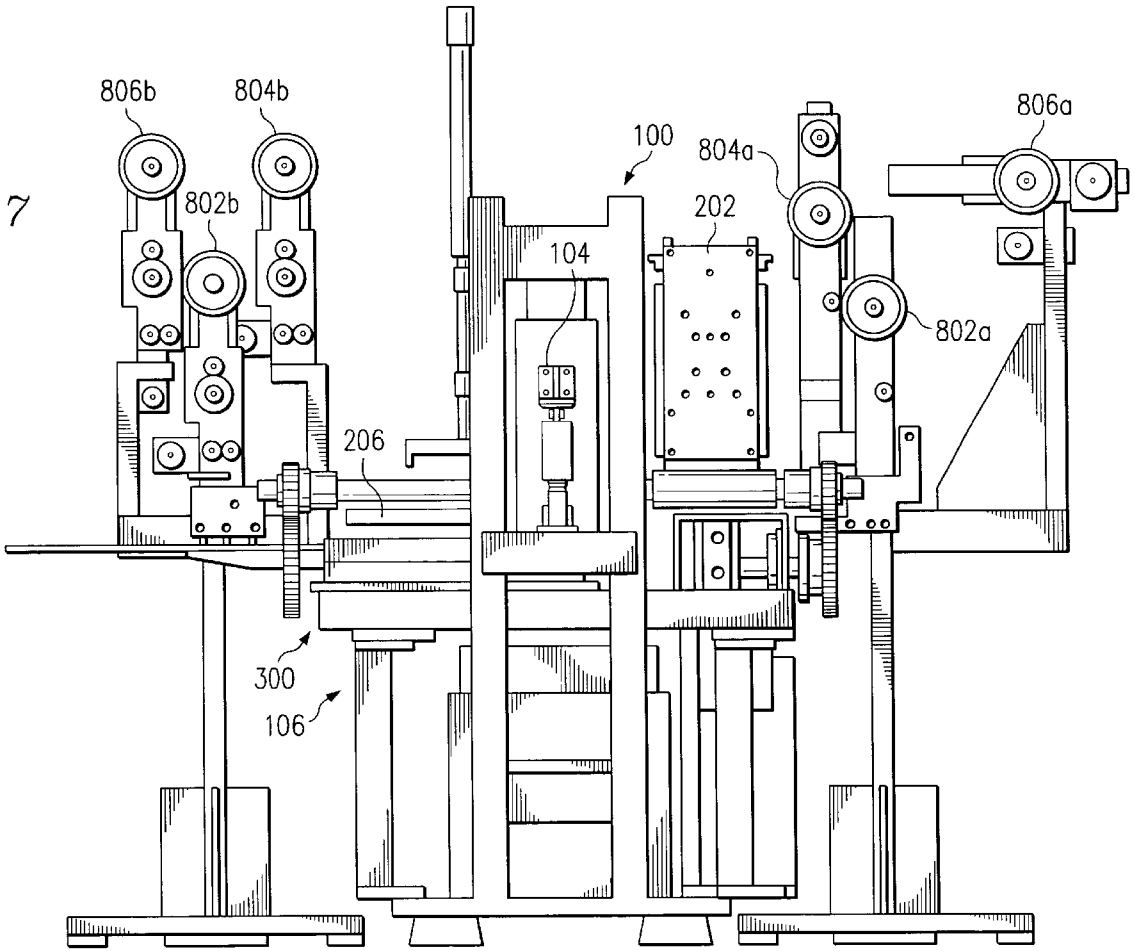
FIG. 17 illustrates a front view of an emboss module for multiple color foil embossing in accordance with the present invention.

FIG. 17 illustrates a front view of an emboss module for multiple color foil embossing in accordance with the present invention. The emboss module of FIG. 17 is similar to the one described in FIG. 16, except that the emboss module of FIG. 17 can be used with three pairs of foil unwind and rewind devices for providing foils with three different colors. For example, the first unwind and rewind devices 802*a*, 802*b* can be used with gold color foils, the second unwind and rewind devices 804*a*, 804*b* can be used with silver color foils, and the third unwind and rewind devices 806*a*, 806*b* can be used with blue foils. In this manner, the foils can be changed from gold to silver to blue, or other combinations thereof. The die changer 202 is illustrated in a vertical position in this figure.

Although various preferred embodiments of the present invention have been disclosed for illustrative purposes, those skilled in the art will appreciate that various modifications, additions and/or substitutions are possible without departing from the scope and spirit of the present invention as disclosed in the claims.

In the previous descriptions, numerous specific details and examples are set forth such as specific components, devices, steps, materials, etc., to provide a thorough understanding of the present invention. However, as one having ordinary skill in the art would recognize, the present invention can be practiced without resorting to the details and examples specifically set forth. Those skilled in the art will readily appreciate that many modifications of the exemplary embodiments are possible without materially departing from the novel teachings and advantages of this invention.

What is claimed:

1. An emboss module for embossing a sheet of material, comprising:

a frame having a scotch yoke and a die changer registration system;

a die changer sub-assembly registered into the die changer registration system, wherein the die changer sub-assembly includes die changers, and wherein the die changer sub-assembly further includes a swing arm having die changer receiving ports, wherein each die changer is registered into one die changer receiving port; and a bolster sub-assembly adapted to move within the frame using the scotch yoke.

2. An emboss module according to claim 1, wherein the swing arm further includes rollers, wherein each roller is connected to one die changer receiving port.

3. An emboss module according to claim 2, wherein each roller is adapted to rotate one die changer receiving port and the die changer registered thereto in a clockwise and counter-clockwise directions.

4. An emboss module according to claim 3, wherein each roller is adapted to rotate about 180 degrees.

5. An emboss module according to claim 1, wherein each die changer includes a die receiving surface having a plurality of pins extending therefrom.

6. An emboss module according to claim 5, wherein each die changer includes heater rods and an insulator.

7. An emboss module according to claim 1, wherein each die changer includes cam followers for registering into the frame.

8. An emboss module according to claim 1, wherein the bolster sub-assembly includes one or more counters.

9. An emboss module according to claim 8, wherein the one or more counters are adapted to receive the sheet of material.

10. An emboss module according to claim 1 further comprising unwind and rewind stands for providing a foil to be stamped between the die changers and the bolster sub-assembly.

11. Se An emboss module according to claim 1 further comprising a plurality of pairs of unwind and rewind stands for providing a plurality of different colored foils to be stamped between the die changers and the bolster sub-assembly.

12. An emboss module according to claim 1 for embossing a sheet of material, comprising:

a frame having a scotch yoke and a die changer registration system, wherein the scotch yoke includes a bolster receiving arm, a pair of rails, and a plurality of wheels positioned on the pair of rails a die changer sub-assembly registered into the die changer registration system, wherein the die changer sub-assembly includes die changers; and a bolster sub-assembly adapted to move within the frame using the scotch yoke.

13. An emboss module according to claim 12, wherein the bolster receiving arm engages the bolster sub-assembly.

14. An emboss module according to claim 13, wherein the bolster receiving arm moves the bolster sub-assembly through the frame using the plurality of wheels on the pair of rails.

15. An emboss module for embossing a sheet of material, comprising:

means for a placing a sheet of material on a bolster sub-assembly;

means for positioning the bolster sub-assembly within a frame, including means for engaging the bolster sub-assembly with a bolster receiving arm such that the bolster receiving arm moves the bolster sub-assembly through the frame using a plurality of wheels on a pair of rails;

means for automatically registering a die on one of a plurality of the die changers;

means for positioning the die directly above the sheet of material; and means for pressing the sheet of material on the die, thereby forming an embossment on the sheet of material.

16. An emboss module according to claim 15, wherein the bolster sub-assembly includes one or more counters.

17. An emboss module according to claim 16, wherein the one or more counters are adapted to receive the sheet of material.

18. An emboss module for embossing a sheet of material, comprising:

means for a placing a sheet of material on a bolster sub-assembly;

means for positioning the bolster sub-assembly within a frame;

means for automatically registering a die on one of a plurality of the die changers, wherein the means for automatically registering the die on one of the die changers comprises means for placing the die on pins of the die changer after the die changer is rotated out of the frame;

means for positioning the die directly above the sheet of material; and means for pressing the sheet of material on the die, thereby forming an embossment on the sheet of material.

19. An emboss module according to claim 18, wherein the die changer is rotated out of the frame using a swing arm having die changer receiving ports, wherein the die changer is registered into one of the die changer receiving ports.

20. An emboss module according to claim 19, wherein the swing arm further includes rollers, wherein each roller is connected to one die changer receiving port.

21. An emboss module according to claim 20, wherein each roller is adapted to rotate one die changer receiving port and the die changer registered thereto in clockwise and counter-clockwise directions.

22. An emboss module according to claim 21, wherein each roller is adapted to rotate about 180 degrees.

23. An emboss module for embossing a sheet of material, comprising:

means for a placing a sheet of material on a bolster sub-assembly;

means for positioning the bolster sub-assembly within a frame;

means for automatically registering a die on one of a plurality of the die changers, wherein each die changer includes a die receiving surface having a plurality of pins extending therefrom;

means for positioning the die directly above the sheet of material; and means for pressing the sheet of material on the die, thereby forming an embossment on the sheet of material.

24. An emboss module for embossing a sheet of material, comprising:

means for a placing a sheet of material on a bolster sub-assembly;

means for positioning the bolster sub-assembly within a frame;

means for automatically registering a die on one of a plurality of the die changers, wherein each die changer includes cam followers for registering into the frame;

means for positioning the die directly above the sheet of material; and means for pressing the sheet of material on the die, thereby forming an embossment on the sheet of material.

* * * * *

UNITED STATES PATENT AND TRADEMARK OFFICE

CERTIFICATE OF CORRECTION

PATENT NO. : 6,676,587 B2
DATED : January 13, 2004
INVENTOR(S) : Smith et al.

It is certified that error appears in the above-identified patent and that said Letters Patent is hereby corrected as shown below:

Column 9,
Line 27, please change "11. Se An emboss module" to -- 11. An emboss module --

Signed and Sealed this

Twenty-seventh Day of April, 2004

JON W. DUDAS
*Acting Director of the United States Patent and Trademark Office*